US006145508A

United States Patent [19]

Seip, Jr.

[11] Patent Number: 6,145,508

[45] Date of Patent: Nov. 14, 2000

[54] COMFORT PILLOW

[76] Inventor: Earl W. Seip, Jr., 725 S. Surf Rd., Ocean City, Md. 21842

[21] Appl. No.: 09/520,002

[22] Filed: Mar. 6, 2000

Related U.S. Application Data

[60] Provisional application No. 60/123,161, Mar. 5, 1999.

[51] Int. Cl.[7] ..... A61G 15/00

[52] U.S. Cl. ..... 128/845; 128/882; 5/648

[58] Field of Search ..... 128/845, 846, 128/869, 876, 882; 5/655, 740, 648, 640, 953; 602/5, 23, 26

[56] References Cited

U.S. PATENT DOCUMENTS

| | | | |
|---|---|---|---|
| 3,924,283 | 12/1975 | Shave | 5/340 |
| 4,177,806 | 12/1979 | Griffin . | |
| 4,736,477 | 4/1988 | Moore . | |
| 4,754,510 | 7/1988 | King | 5/648 |
| 4,889,584 | 12/1989 | Simon | 5/648 |
| 4,905,715 | 3/1990 | Johnson | 128/882 |
| 5,216,771 | 6/1993 | Hoff | 5/648 |
| 5,269,322 | 12/1993 | Mandel . | |
| 5,418,991 | 5/1995 | Shiflett . | |

*Primary Examiner*—Michael A. Brown
*Attorney, Agent, or Firm*—Birch, Stewart, Kolasch & Birch, LLP

[57] ABSTRACT

A comfort pillow is attachable to one leg of a person in order to keep the person's knees separated while resting or sleeping. The comfort pillow includes upper and lower pads which are located adjacent to the user's thigh and calf, respectively. A middle section made of batting material is located adjacent to the user's knee. A pair of straps fasten the comfort pillow to the leg of the user. The batting material of the middle section allows the comfort pillow to bend and follow the natural movements of the user's knee. The comfort pillow allows the user's spine to remain straight during rest or sleep, particularly for persons lying on their side, and the straps retain the comfort pillow between the user's knees throughout the sleeping period.

20 Claims, 2 Drawing Sheets

COMFORT PILLOW

The present application is a non-provisional conversion application of provisional application No. 60/123,161, filed Mar. 5, 1999, the entire contents of which are hereby incorporated by reference.

BACKGROUND OF THE INVENTION

1. Field of the Invention

The present invention is directed to a comfort pillow which is placed between the knees of a person while resting or sleeping. More particularly, the present invention is related to a comfort pad that straps to one leg and maintains the user's knees in spaced-apart relation which helps to maintain the user's spine in an aligned condition during rest or sleep.

2. Description of the Background Art

In the past, a person resting or sleeping may place an ordinary pillow or blanket between their knees in order to keep their knees from touching during sleep or rest. However, invariably the pillow or blanket will become dislodged from its location between the knees of the person (user), and therefore becomes useless until the user awakens and repositions the pillow or blanket back between their knees. Also, the size of the pillow or blanket may not be appropriate for optimum comfort.

Various attempts have been made to develop a pillow for placement between a person's knees. U.S. Pat. No. 4,177,806 to Griffin shows a knee pillow formed of a single piece of foamed rubber which may be strapped to a person's leg at the knee to prevent chaffing of one knee against another. U.S. Pat. No. 4,736,477 to Moore shows a knee pillow formed of a single piece of foam core which may be strapped to a person's leg at the knee, and which includes slits and a V-groove therein to permit flexure of the foam core pillow. U.S. Pat. No. 5,269,322 to Mandel shows a spinal stress reducing apparatus locatable between and strapped to a person's leg at the knee. The apparatus is formed of a single resilient foam member, and includes a centrally-projecting shroud which abuts against the adjacent knee. Finally, U.S. Pat. No. 5,418,991 to Shiflett shows a knee pillow which may be strapped to a person's leg at the knee for immobilizing the leg, and which therefore restricts flexural movement of the leg about the knee joint.

There is a need in the art for a comfort pillow which may be located between the knees of a user and which will remain in position throughout the night, while still allowing freedom of motion of the user's legs without causing dislodgment of the comfort pillow.

SUMMARY OF THE INVENTION

The present invention is directed to a comfort pad that straps to one leg of a person (user) who is resting or sleeping. The comfort pad, or comfort pillow, fits between the legs of the wearer and replaces a pillow or a blanket which is typically the only device available to the person (user). With the comfort pad strapped to one leg of the user, the user can move around while sleeping, move from side-to-side, toss-and-turn, all without shifting or dislocating the comfort pad from its proper position on the leg of the user and between the user's knees. The comfort pad of the present invention keeps the knees from touching one another and helps to keep the spine straight and aligned, particularly for someone sleeping or resting on their side.

The present invention is achieved by a pillow for placement between the knees of two human legs. The pillow comprises a cover member having a length defining a length direction and a width defining a width direction. The cover member is divided into a first section, a second section, and a third section aligned one after another along the length direction. The cover member is preferably made of cloth fabric. The cover member is divided into the three separate sections by a first row of stitching located between the first section and the second section, and a second row of stitching located between the second section and the third section. The length of the cover member is approximately 3 times larger than the width of the cover member.

A first cushion is located within the first section, a second cushion is located within the second section, and a third cushion is located within the third section. The third cushion has a thickness in a range of 1.5 to 2 times thicker than a thickness of the first cushion. The first cushion and the third cushion are formed of a first cushion material, and the second cushion is formed of a second cushion material different from the first cushion material. The first cushion material is preferably a foam pad, and the second cushion material is preferably loose batting material.

A first strap is attached to the first section and extends away from the first section in the width direction. A second strap is attached to the third section and extends away from the third section in the width direction. The first and second straps are made of a non-elastic material and extend substantially parallel to the first and second rows of stitching. Each of the first and second straps comprise a pair of strap members releaseably connected together by a hook and loop fastener.

A protective cover made of cloth fabric may be placed over the cover member. The protective cover includes an opening at one end thereof for passage of the cover member therethrough and into the protective cover, and a plurality of slits therein for passage of the first and second straps therethrough.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
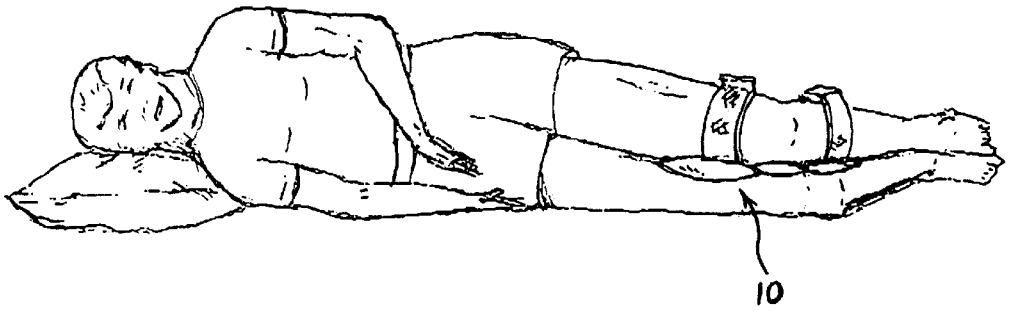
FIG. 1 is a view showing a user wearing the comfort pillow of the present invention between his knees while in a lying down position.
Figure 2:
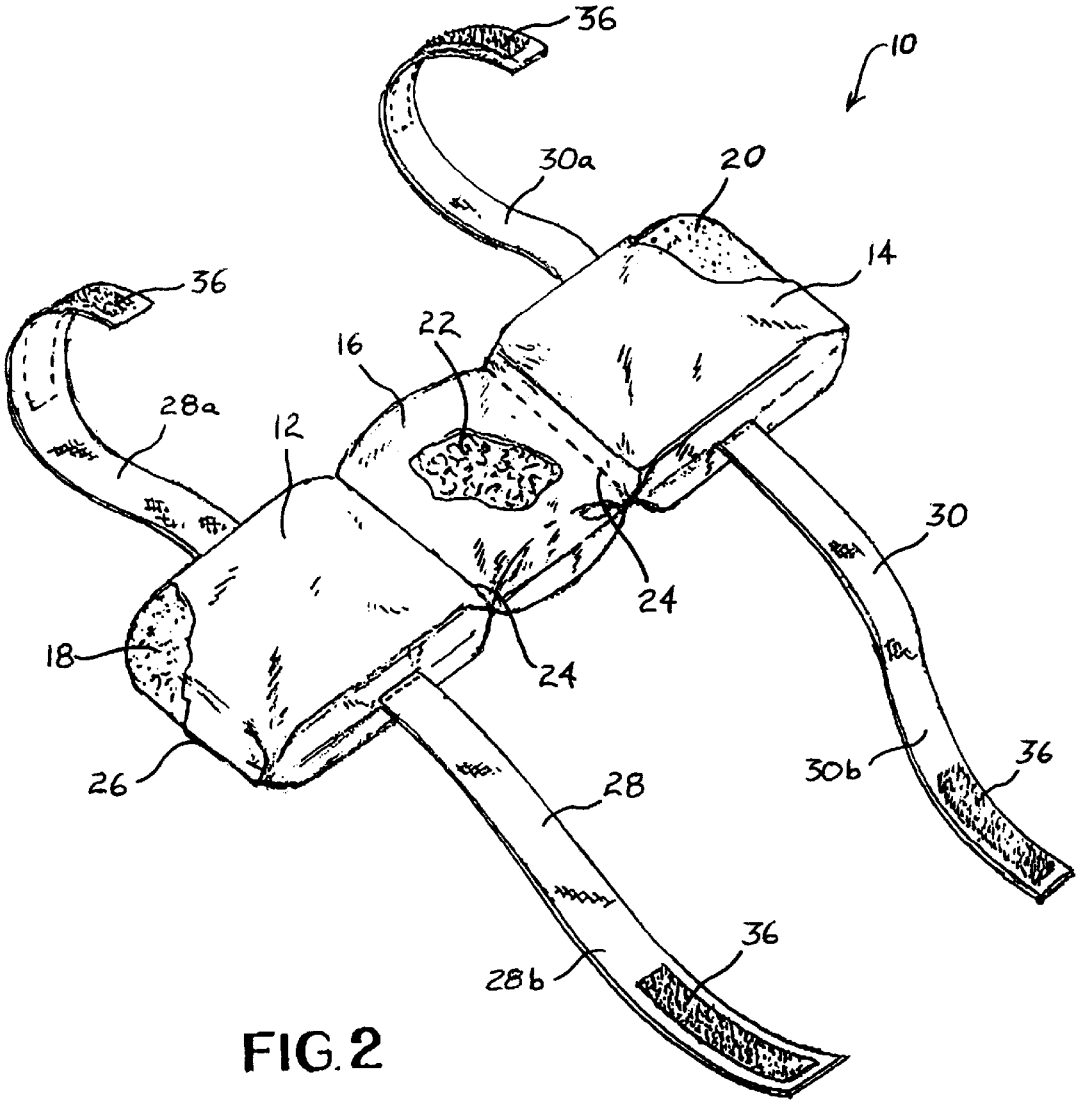
FIG. 2 is a partially cut-away perspective view of the comfort pillow of the present invention with the protective cover removed.
Figure 3:
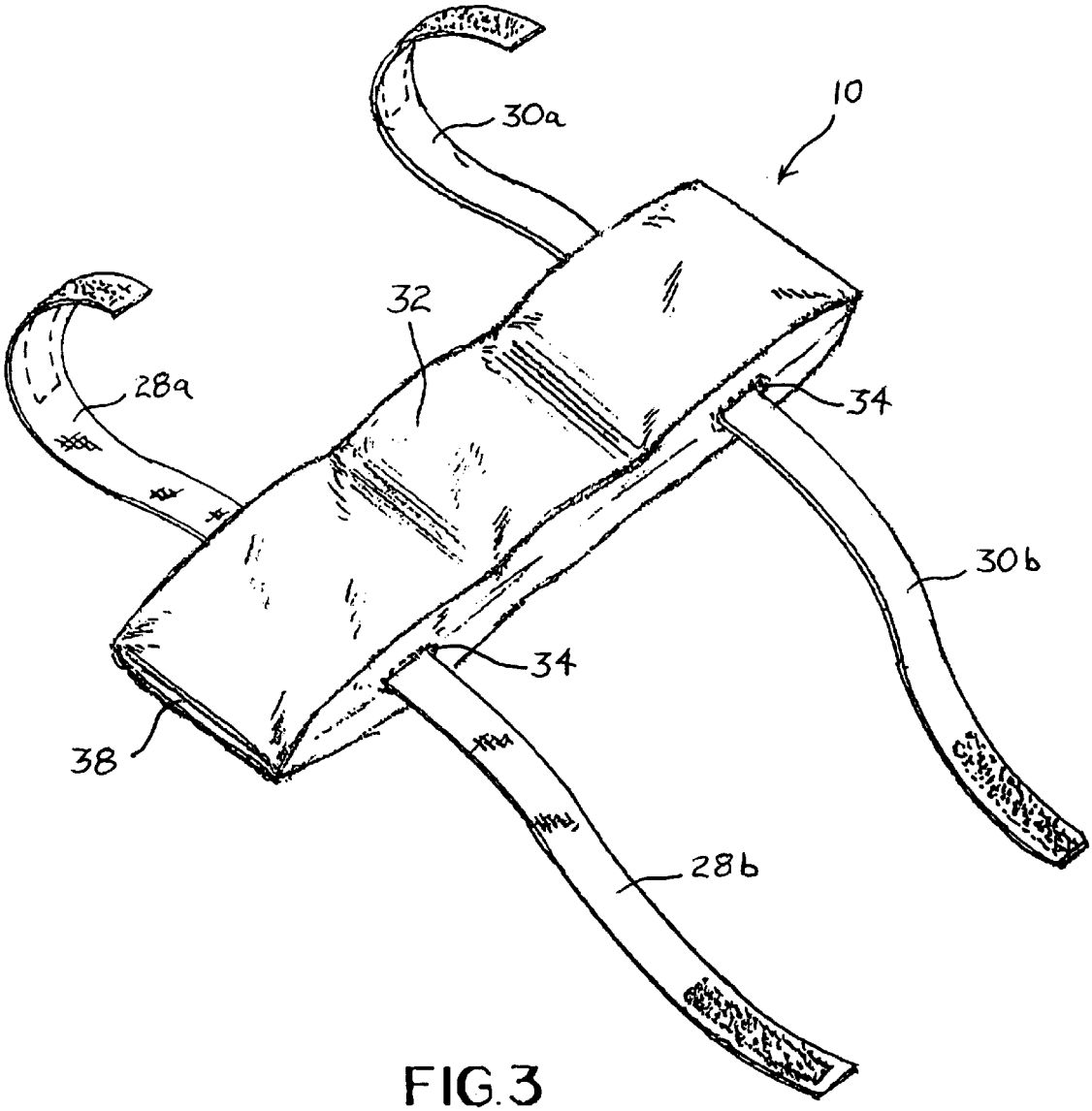
FIG. 3 is a perspective view of the comfort pillow of the present invention with the protective cover placed thereon.

The present invention will now be described, with particular reference to the drawing figures.

The comfort pillow 10 includes an upper section 12, a lower section 14, and a middle section 16 located between the upper section 12 and the lower section 14. The upper section 12 includes an upper pad 18 therein, and the lower section 14 includes a lower pad 20 therein. The upper pad 18 and the lower pad 20 are preferably made of foam, although other materials such as gel, down or Holofil may be used. The middle section 16 includes a middle pad 22 which is preferably made of polyester batting, although other materials such as down, Holofil, gel or crumbled-foam may be used. The divisions between upper section 12, lower section 14, and middle section 16 are formed by two parallel rows of stitching 24 provided in an inner cover 26. The inner cover 26 is preferably made of a cotton and polyester blend, although any suitable cloth fabric may be utilized.

An upper strap 28 is attached to the upper section 12, and a lower strap 30 is attached to the lower section 14. The upper strap 28 includes a first upper strap portion 28*a* which is attached to one side of the inner cover 26 at the upper section 12, and a second upper strap portion 28*b* which is attached to the other side of the inner cover 26 at the upper section 12. The lower strap 30 includes a first lower strap portion 30*a* which is attached to one side of the inner cover 26 at the lower section 14, and a second lower strap portion 30*b* which is attached to the other side of the inner cover 26 at the lower section 14. The upper strap 28 and the lower strap 30 are preferably attached to the inner cover 26 by stitching, although other attachment methods may be utilized. The straps are preferably two-inches wide and made of flexible strapping or webbing material. The ends of each of the upper strap portions 28*a,* 28*b,* and lower strap portions 30*a,* 30*b,* include a releasable fastener such as a hook-and-loop fastener (Velcro) for releasably fastening the first and second strap portions together when the comfort pillow 10 is placed on a leg of a user.

The comfort pillow 10 may be formed in various sizes to fit various users. For example, a small comfort pillow 10 and a large comfort pillow 10 may be formed. Ideally, for the small comfort pillow, the upper section 12 will be approximately four-inches wide and six-inches long; the middle section 16 will be approximately four-inches wide and three-inches long; and the lower section 14 will be approximately four-inches wide and six-inches long. Therefore, the overall dimensions of the small-sized comfort pillow will be approximately four-inches by fifteen-inches. An outer cover 32 is placed over the inner cover 26, which can be removed for easy laundering purposes. The outer cover 32 is preferably made of a cotton and polyester blend, although other suitable materials may be utilized. For the small-size comfort pillow, the outer cover 32 would measure approximately five-inches by sixteen-inches. Slits 34 are placed in the sides of the outer cover 32 which allow the upper and lower straps 28, 30 to pass therethrough.

For a medium-size comfort pillow, the upper section 12 would measure approximately five-inches by seven-inches; the middle section 16 would measure approximately five-inches by three and one half-inches; and the lower section 14 would measure approximately five-inches by seven-inches. Therefore, the overall dimensions of the medium-size comfort pillow would be approximately five-inches by seventeen and one half-inches. For the medium-size comfort pillow, an outer cover 32 measuring approximately six-inches by eighteen and one half-inches would be utilized.

For a large-size comfort pillow, the upper section 12 would measure approximately six-inches by eight-inches; the middle section 16 would measure approximately six-inches by four-inches; and the lower section 14 would measure approximately six-inches by eight-inches. Therefore, the overall dimensions of the large-size comfort pillow would be approximately six-inches by twenty-inches. For the large-size comfort pillow, an outer cover 32 measuring approximately seven-inches by twenty-one-inches would be utilized. Of course, it should be understood that other suitable dimensions may be utilized as appropriate to fit the particular needs of the individual user.

For the small-size comfort pillow, the thickness of the upper pad 18 is approximately one-inch, and the thickness of the lower pad 20 is approximately two-inches. For the medium-size comfort pillow, the thickness of the upper pad 18 is approximately one-inch to two-inches, and the thickness of the lower pad 20 is approximately two-inches to three-inches. For the large-size comfort pillow, the thickness of the upper pad 18 is approximately two-inches, and the thickness of the lower pad 20 is approximately three-inches. However, it should be understood that other suitable dimensions may be utilized as appropriate to fit the particular needs of the individual user. For the small-size comfort pillow, the thickness of the middle pad 22 may be approximately one to two inches, and for the large-size comfort pillow 10, the middle pad 22 may be approximately two to three inches thick.

With regard to the middle section 16, because the middle section is formed of a batting type material such as polyester, the middle section 16 may be easily bent, as shown in FIG. 1, so as to allow the comfort pillow 10 to follow the natural bending movement of the user's knee.

The straps 28, 30 are preferably made of a non-elastic material to provide the greatest amount of comfort to the user. However, it should be understood that other materials may be utilized for the straps which include some elasticity therein.

The length of the straps 28, 30 are suitably dimensioned to fit around the legs of the user. For example, the total length of the straps 28, 30 for the small-size comfort pillow would preferably measure twenty-seven-inches, while the length of the straps 28, 30 for the large-size comfort pillow would measure approximately thirty-inches.

The outer cover 32 includes an opening 38 at one end thereof which allows it to slip over the inner cover 26 for use. The opening 38 may include any suitable closure mechanism, such a zipper, buttons, snaps, etc. The entire device may be laundered with or without removing the outer cover 32.

In use, the comfort pillow 10 is placed alongside the inner portion of a user's leg such that the upper section 12 is adjacent to the user's thigh, the middle section 16 is adjacent to the user's knee, and the lower section 14 is adjacent to the user's calf. The upper strap 28 is wrapped around the user's thigh, and the releasable fasteners 36 are engaged with one another, and the lower strap 30 is wrapped around the calf of the user, and the releasable fasteners 36 are engaged with one another. The user may then rest or sleep comfortably while the comfort pillow 10 remains in place around the user's leg, while still providing flexibility of motion of the user due to the bendability of the middle section 16 of the comfort pillow 10. Because the comfort pillow 10 is dimensioned as set forth above, the user's knees remain separated such that the user's spine remains aligned while resting or sleeping.

The comfort pillow 10 of the present invention is particularly suitable for people with bad knees or bad backs, or who have spine or nerve problems. Also, elderly people, people in nursing homes or hospitals may find the comfort pillow 10 particularly beneficial. However, any person may benefit from the use of the comfort pillow 10 which will allow them to obtain a better night's sleep.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A pillow for placement between the knees of two human legs, said pillow comprising:

a cover member having a length defining a length direction and a width defining a width direction, said cover member being divided into a first section, a second section, and a third section aligned one after another along said length direction;

a first cushion located within said first section;

a second cushion located within said second section;

a third cushion located within said third section;

a first strap attached to said first section and extending away from said first section in said width direction; and a second strap attached to said third section and extending away from said third section in said width direction, wherein said first cushion and said third cushion are formed of a first cushion material, and said second cushion is formed of a second cushion material different from said first cushion material.

2. The pillow according to claim 1, wherein said first cushion material is a pad, and said second cushion material is loose batting material.

3. The pillow according to claim 1, wherein said first cushion material is a foam pad, and said second cushion material is polyester batting.

4. The pillow according to claim 1, wherein said third cushion has a thickness greater than a thickness of said first cushion.

5. The pillow according to claim 1, wherein said thickness of said third cushion is in a range of 1.5 to 2 times thicker than said thickness of said first cushion.

6. The pillow according to claim 1, wherein said cover member is made of cloth fabric.

7. The pillow according to claim 1, wherein said length of said cover member is approximately 3 times larger than said width of said cover member.

8. The pillow according to claim 1, wherein said cover member is divided into said sections by a first row of stitching located between said first section and said second section, and a second row of stitching located between said second section and said third section.

9. The pillow according to claim 8, wherein said first and second straps extend substantially parallel to said first and second rows of stitching.

10. The pillow according to claim 1, wherein each of said first and second straps comprises a pair of strap members releaseably connected together by a fastener.

11. The pillow according to claim 10, wherein said fastener is a hook and loop fastener.

12. The pillow according to claim 1, wherein said first and second straps are made of a non-elastic material.

13. The pillow according to claim 1, further comprising a protective cover placed over said cover member.

14. The pillow according to claim 13, wherein said protective cover is made of cloth fabric.

15. The pillow according to claim 13, wherein said protective cover includes a plurality of slits therein for passage of said first and second straps therethrough.

16. The pillow according to claim 13, wherein said protective cover has an opening at one end thereof for passage of said cover member therethrough and into said protective cover.

17. The pillow according to claim 1, wherein said cover member is divided into said sections by a first row of stitching located between said first section and said second section, and a second row of stitching located between said second section and said third section, and wherein said first and second straps are made of a non-elastic material and extend substantially parallel to said first and second rows of stitching, each of said first and second straps comprising a pair of strap members releaseably connected together by a hook and loop fastener.

18. The pillow according to claim 17, wherein said first cushion material is a foam pad, said second cushion material is loose batting material, and said cover member is made of cloth fabric.

19. The pillow according to claim 18, further comprising a protective cover placed over said cover member, said protective cover being made of cloth fabric, said protective cover including an opening at one end thereof for passage of said cover member therethrough and into said protective cover, and a plurality of slits therein for passage of said first and second straps therethrough.

20. The pillow according to claim 19, wherein said length of said cover member is approximately 3 times larger than said width of said cover member, and said third cushion has a thickness in a range of 1.5 to 2 times thicker than a thickness of said first cushion.

* * * * *